US009343877B2

(12) United States Patent
Hasegawa et al.

(10) Patent No.: US 9,343,877 B2
(45) Date of Patent: May 17, 2016

(54) SPARK PLUG AND MANUFACTURING METHOD THEREOF

(71) Applicant: NGK Spark Plug Co., LTD., Nagoya (JP)

(72) Inventors: Yukinobu Hasegawa, Nagoya (JP); Kei Takahashi, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 14/555,119

(22) Filed: Nov. 26, 2014

(65) Prior Publication Data

US 2015/0145402 A1 May 28, 2015

(30) Foreign Application Priority Data

Nov. 28, 2013 (JP) ..... 2013-246029
Nov. 18, 2014 (JP) ..... 2014-233332

(51) Int. Cl.

*H01T 13/20* (2006.01)
*H01T 13/32* (2006.01)
*H01T 13/46* (2006.01)
*H01T 21/02* (2006.01)

(52) U.S. Cl.

CPC ..... *H01T 13/32* (2013.01); *H01T 13/467* (2013.01); *H01T 21/02* (2013.01)

(58) Field of Classification Search

CPC ..... H01T 13/20; H01T 13/32; H01T 21/02; H01T 13/39; H01T 31/02; H01T 13/28

USPC ..... 313/118, 135, 137, 141–145

See application file for complete search history.

(56) References Cited

U.S. PATENT DOCUMENTS 5,530,313 A * 6/1996 Chiu ..... H01T 21/02 219/78.01
6,320,302 B1 * 11/2001 Simon ..... H01T 13/39 313/135
2002/0079800 A1 * 6/2002 Miyashita ..... H01T 13/52 313/143
2004/0080252 A1 * 4/2004 Ito ..... H01T 13/39 313/141
2006/0202599 A1 * 9/2006 Kato ..... H01T 13/14 313/143
2008/0238283 A1 * 10/2008 Nakamura ..... H01T 13/50 313/143
2011/0148274 A1 6/2011 Ernst et al.
2011/0241522 A1 * 10/2011 Quitmeyer ..... H01T 21/02 313/141
2012/0176020 A1 * 7/2012 Quitmeyer ..... H01T 21/02 313/141
2012/0248964 A1 10/2012 Thomas et al.
2012/0299459 A1 * 11/2012 Sakakura ..... H01T 13/32 313/141
2013/0278133 A1 * 10/2013 Sakayanagi ..... H01T 21/02 313/142
2014/0225496 A1 * 8/2014 Kawai ..... H01T 21/02 313/141
2015/0145403 A1 * 5/2015 Mizutani ..... H01T 13/32 313/141

FOREIGN PATENT DOCUMENTS

JP 02-37485 U 3/1990
JP 2012-216507 A 11/2012

* cited by examiner

*Primary Examiner* — Nimeshkumar Patel
*Assistant Examiner* — Kevin Quarterman
(74) *Attorney, Agent, or Firm* — Leason Ellis LLP

(57) ABSTRACT

A spark plug includes a center electrode, a ground electrode, and a cylindrical metal shell. The ground electrode is welded to the metal shell via a weld portion. The weld portion is formed along the outer circumference end part of an annular part in the ground electrode. The weld portion has a plurality of melt extending parts extending toward the inner circumference side from the outer circumference end part of the annular part and aligned such that adjacent ones are connected to each other at the end part. The plurality of melt extending parts partially include smaller melt extending parts whose melting depth is smaller than others.

6 Claims, 14 Drawing Sheets

FIG. 8

| SAMPLE NO. | WELDING CONDITION | | PRESENCE OF WELDING STRENGTH REDUCTION (REFERENCE 7600 N) |
|---|---|---|---|
| | IRRADIATION TIMES OF LOWER OUTPUT LASER/ ALL IRRADIATION TIMES OF LASER | RATIO OF LOWER OUTPUT LASER PROCESS | |
| S01 | 2/125 | 1.60% | NON |
| S02 | 5/125 | 4% | NON |
| S03 | 7/125 | 5.60% | NON |
| S04 | 20/125 | 16% | NON |
| S05 | 25/125 | 20% | NON |
| S06 | 30/125 | 24% | YES |

FIG. 9

| EXTENDING PART REDUCTION RATE | FORMING RANGE OF SMALLER MELT EXTENDING PART (2% OF ENTIRE CIRCUMFERENCE) | FORMING RANGE OF SMALLER MELT EXTENDING PART (5% OF ENTIRE CIRCUMFERENCE) | FORMING RANGE OF SMALLER MELT EXTENDING PART (6% OF ENTIRE CIRCUMFERENCE) | FORMING RANGE OF SMALLER MELT EXTENDING PART (20% OF ENTIRE CIRCUMFERENCE) |
|---|---|---|---|---|
| 97% | C | C | C | C |
| 96% | B | B | B | B |
| 93% | B | B | B | B |
| 86% | B | B | A | A |
| 79% | B | B | A | A |
| 72% | A | A | A | A |
| 35% | B | B | B | B |
| 34% | C | C | C | C |

| | | OCCURRENCE RATIO OF WELD BEAD EXPANSION |
|---|---|---|
| EVALUATION | A | 30% OR LESS |
| | B | 30 TO 50% |
| | C | 50% OR GREATER |

FIG. 10

| WELD POSITION WP (mm) | LASER REFERENCE OUTPUT LS (W) | | | | | | |
|---|---|---|---|---|---|---|---|
| | 1100 | 1200 | 1300 | 1400 | 1500 | 1600 | 1700 |
| 0.25 | | B | | | | B | |
| 0.2 | B | A | | | | A | B |
| 0.15 | | A | | | | A | |
| 0.1 | | | A | | A | | |
| 0.05 | | | | | | | B |
| 0 | | | | A | | A | |
| −0.05 | | | | | | | |
| −0.1 | | | A | | A | | |
| −0.15 | | A | | | | A | |
| −0.2 | B | A | | | | A | B |
| −0.25 | | B | | | | B | |

| EVALUATION | | |
|---|---|---|
| | A | WELDING STRENGTH: 8000 N OR GREATER, 10 OR LESS SPATTERS |
| | B | WELDING STRENGTH: LESS THAN 8000 N, 11 OR MORE SPATTERS |

| | | LASER REFERENCE OUTPUT LS (W) | | | | |
|---|---|---|---|---|---|---|
| | | 1200 | 1300 | 1400 | 1500 | 1600 |
| WELD POSITION WP (mm) | 0.2 | 90 TO 100% | | | | |
| | 0.1 | | 100 TO 120% | | 120% OR GREATER | 120% OR GREATER |
| | 0 | | | 120% OR GREATER | | |
| | −0.1 | | 120% OR GREATER | | 120% OR GREATER | 120% OR GREATER |
| | −0.2 | 100 TO 120% | | | | |

FIG. 16

LASER OUTPUT DETAILS
(TOTAL LASER IRRADIATION TIMES: 125)

| | |
|---|---|
| 1ST TO 116TH | 1400 W (REFERENCE OUTPUT) |
| 117TH | 1300 W |
| 118TH | 1200 W |
| 119TH | 1100 W |
| 120TH | 1000 W |
| 121TH | 900 W |
| 122TH | 800 W |
| 123TH | 700 W |
| 124TH | 600 W |
| 125TH | 500 W |

| RATIO OF LASER OUTPUT REDUCTION |
|---|
| 9/125×100=7.2% |

| OCCURRENCE RATIO OF WELD BEAD EXPANSION |
|---|
| 10% OR LESS |

SPARK PLUG AND MANUFACTURING METHOD THEREOF

This application claims the benefit of Japanese Patent Applications No. 2013-246029, filed Nov. 28, 2013 and No. 2014-233332, filed Nov. 18, 2014, all of which are incorporated by reference in their entities herein.

FIELD OF THE INVENTION

The present invention relates to a spark plug and a manufacturing method thereof.

BACKGROUND OF THE INVENTION

A spark plug has a center electrode and a ground electrode. The center electrode is held by an insulator, and the ground electrode is fixed by a metal shell accommodating that insulator. Between the center electrode and the ground electrode, a clearance for generating a spark discharge is formed. In the followings, this clearance is also referred to as "spark gap." The spark plug ignites a gas supplied into a combustion chamber of an internal combustion engine by generating the spark discharge at the spark gap.

In some spark plugs, a metallic member is joined to an opening end part that is an end part of an opening edge in the front end side of the metal shell. For example, in the spark plug in JP-UM-A-2-37485, an annular ground electrode is weld-joined to the opening end part in the front end side of the metal shell. In the followings, the metallic member joined to the opening end part in the front end side of the metal shell is also referred to as "front end member."

Problem to be Solved by the Invention

In the spark plug, it is desirable that the joining property of the front end member to the metal shell be ensured at a sufficiently high level. In the mounting of the spark plug to the internal combustion engine, as the front end part of the metal shell is inserted into the through hole on the outer wall of the combustion chamber, it is desirable to suppress the occurrence of degradation in the appearance such as a significant expansion of a welded mark (a weld bead), a fouling due to a spattering, and the like in the weld-joining of the front end member. As such, in the spark plug in which the front end member is joined to the opening end part in the front end side of the metal shell, it has been desired to improve the joining quality between the front end member and the metal shell.

SUMMARY OF THE INVENTION

Means for Solving the Problems

The present invention has been made to solve at least the above-described problems in the spark plug having the front end member, and can be implemented in the following forms.

[1] According to one form of the present invention, a spark plug is provided. This spark plug has: a shaft-like center electrode extending in an axial line direction; a cylindrical insulator accommodating the center electrode therein such that a front end part of the center electrode is exposed out of a front end side of the insulator; a cylindrical metal shell accommodating the insulator therein; a front end member arranged in a front end part of the metal shell and having an opening opened in the axial line direction; and a weld portion that is formed along an outer circumference end part of the front end member and in which the front end member and the metal shell have been mutually melted. The weld portion may have a plurality of melt extending parts each extending toward an inner circumference side from the outer circumference end part of the front end member, and the plurality of melt extending parts may be provided aligned along the outer circumference end part of the front end member such that neighboring ones are connected to each other in an outer-circumference-side end part, and partially include a smaller melt extending part in which a melting depth Dm, which is a distance between a vertex of the melt extending part that is a furthest part from a surface of the weld portion in each of the melt extending parts and the surface of the weld portion, is smaller than other melt extending parts. According to the spark plug of this form, the melting depth of a part of the melt extending parts is adjusted to be smaller in the weld portion and, thereby, the joining quality between the front end member and the metal shell is improved.

[2] In the spark plug of the above-described form, the weld portion may have a melt valley part between the neighboring melt extending parts, the melt valley part may include a larger melt valley part in which a distance Dr between a surface of the weld portion in a cross section and a vertex of the melt valley part, in which the cross section passes through a vertex of the melt extending part having the largest melting depth Dm in the plurality of melt extending parts and is orthogonal to a center axis of the metal shell and in which the vertex is a part closest to the surface of the weld portion in the melt valley part, is 15% or greater of an average of distances Ds between the surface of the weld portion in the cross section and the vertex of the melt extending part for all the melt extending parts, and the larger melt valley part may occupy 80% or greater of all the melt valley parts in the cross section. According to the spark plug of this form, even when the smaller melt extending part is included in a part of the melt extending parts of the weld portion, the joining strength between the front end member and the metal shell is ensured.

[3] In the spark plug of the above-described form, in a continuous part of 2% or greater of an entire circumference of the weld portion, the weld portion may have, as the smaller melt extending part, the melt extending part in which the distance Ds between the surface of the weld portion and the vertex of the melt extending part in the cross section is 35% or greater and 96% or less of an average of the distances Ds between the surface of the weld portion and the vertex of the melt extending part in the cross section for all the melt extending parts. According to the spark plug of this form, the degradation in the appearance state due to the weld-joining of the front end member is suppressed.

[4] In the spark plug of the above-described form, in a continuous part of 6% or greater of an entire circumference of the weld portion, the weld portion may have, as the smaller melt extending part, the melt extending part in which the distance Ds between the surface of the weld portion and the vertex of the melt extending part in the cross section is 72% or greater and 86% or less of an average of the distances Ds between the surface of the weld portion and the vertex of the melt extending part in the cross section for all the melt extending parts. According to the spark plug of this form, the degradation in the appearance state due to the weld-joining of the front end member is further suppressed.

[5] In the spark plug of the above-described form, a boundary face in which the metal shell is in surface-contact with the front end member at a more inner circumference side than the weld portion in a radial direction of the metal shell may be provided, and each of distances from vertexes of the plurality of melt extending parts to a virtual plane including the boundary face may be less than or equal to 0.2 mm. According to the spark plug of this form, the joining strength between the front end member and the metal shell is ensured and the degradation in the appearance state due to the weld-joining of the front end member is suppressed.

[6] In the spark plug of the above-described form, the weld portion may be formed by being irradiated with a laser for a plurality of times at a predetermined pitch along an outer circumference end part of the front end member, the plurality of melt extending parts may be parts formed in a part where the laser has been irradiated, and the smaller melt extending part may be formed at least in a part where the laser has finally been irradiated. According to the spark plug of this form, in the weld-joining of the front end member, the degradation in the appearance state due to the last laser irradiation is suppressed.

[7] According to another embodiment of the present invention, a manufacturing method of a spark plug is provided. This manufacturing method includes: (A) an arrangement process for preparing a cylindrical metal shell accommodating therein a shaft-like center electrode extending in an axial line direction and a cylindrical insulator accommodating the center electrode therein such that a front end of the center electrode is exposed out of a front end of the insulator, and arranging, to a front end part of the metal shell, a front end member having an opening opened in the axial line direction; and (B) a joining process for forming a weld portion over the entire circumference of the front end member in which the metal shell and the front end member are mutually melted by irradiating a plurality of parts along an outer circumference end part of the front end member with a laser at a predetermined pitch to join the front end member and the metal shell to each other. The joining process may include a lower output process for irradiating a part of the plurality of parts with the laser at a lower output than for other part. According to the manufacturing method of the spark plug of this form, one of the portions of the weld portion is formed at the reduced laser output, so that the joining quality between the front end member and the metal shell is improved.

[8] In the manufacturing method of the above-described form, the lower output process may be a process for irradiating a continuous part of 2% or greater of an entire circumference of the front end member with a lower output laser. According to the manufacturing method of the spark plug of this form, the degradation in the appearance state due to the weld-joining of the front end member is suppressed.

[9] In the manufacturing method of the above-described form, the lower output process may be a process for irradiating a continuous part of 8% or greater of an entire circumference of the front end member with a lower output laser. According to the manufacturing method of the spark plug of this form, the degradation in the appearance state due to the weld-joining of the front end member is suppressed.

[10] In the manufacturing method of the above-described form, the lower output process may be performed at least when the laser is finally irradiated in the joining process. According to the manufacturing method of the spark plug of this form, the degradation in the appearance state due to the final laser irradiation is suppressed in the weld-joining of the front end member.

The present invention can be implemented in various forms other than the spark plug and the manufacturing method thereof. For example, it can be implemented in the forms of a manufacturing apparatus of the spark plug, a joining method and a joining apparatus of the front end member and the metal shell, a computer program for implementing these methods and apparatus, a non-transitory recording medium in which such the computer program is recorded, and so on.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 8 is an illustration indicating an experiment result of an experiment in which a welding strength of the front end member and the metal shell was examined;

FIG. 9 is an illustration indicating an experiment result of an experiment in which an occurrence rate of a weld bead expansion in the welding process for forming the weld portion was examined;

FIG. 10 is an illustration indicating an experiment result of an experiment in which a weld position and a laser reference output suitable for forming the weld portion were examined;

FIG. 16 is an illustration for illustrating a verification experiment in which an occurrence rate of a weld bead expansion in the weld portion of the second embodiment was examined.

DETAILED DESCRIPTION OF THE INVENTION

Description of Embodiments

A. First Embodiment:

[Configuration of Spark Plug]

Figure 1:
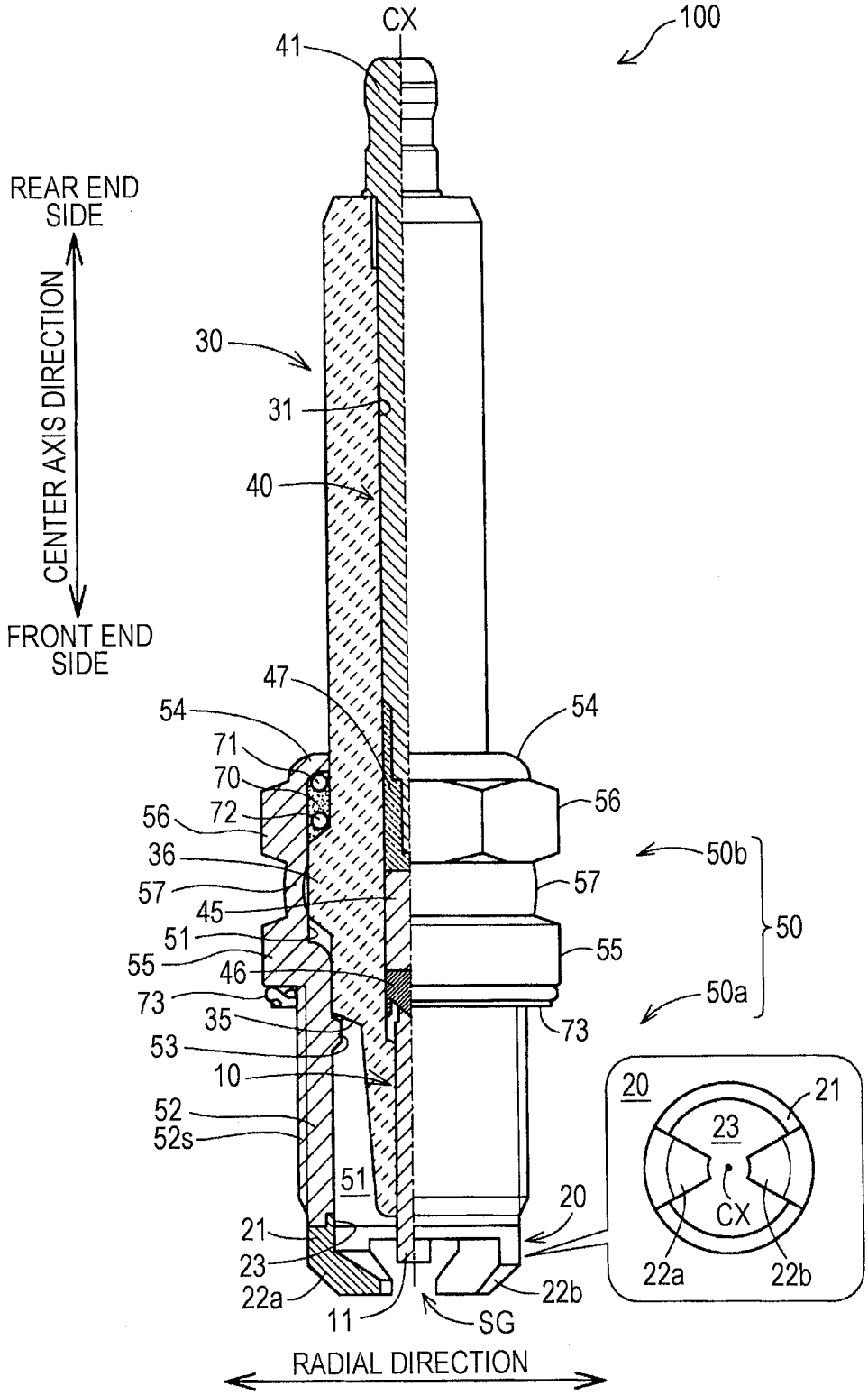
FIG. 1 is a schematic drawing illustrating the entire configuration of a spark plug.
Figure 2:
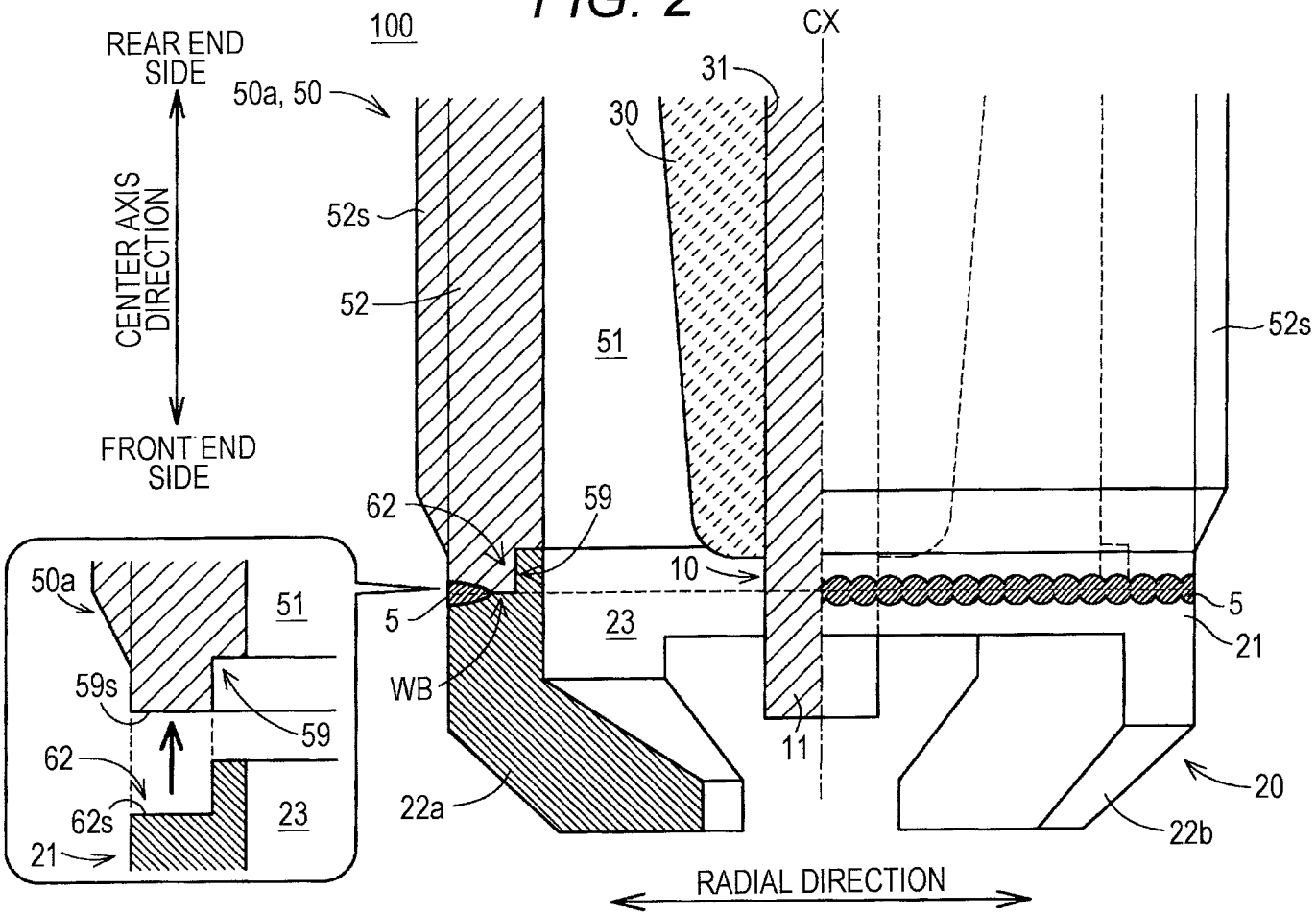
FIG. 2 is a schematic drawing illustrating a configuration of a front end part of the spark plug.

FIG. 1 and FIG. 2 are schematic drawings illustrating a configuration of a spark plug 100 as a first embodiment of the present invention. FIG. 1 illustrates the entire configuration of the spark plug 100 and FIG. 2 illustrates the configuration of the front end part of the spark plug 100. In FIG. 1 and FIG. 2, a center axis CX of the spark plug 100 is depicted by a dot chain line. In the followings, in the present specification, the direction parallel to the center axis CX is referred to as "center axis direction" and the direction orthogonal to the center axis direction is referred to as "radial direction."

In FIG. 1 and FIG. 2, the part in the sheet left side of the center axis CX of the spark plug 100 depicts the schematic sectional drawing and the part in the sheet right side of the center axis CX depicts the schematic outline drawing. In FIG. 1, a ground electrode 20 when viewed in the center axis direction from the front end side to the rear end side is depicted within the balloon. In FIG, 1, the depiction of a weld portion 5 is omitted for the purpose of illustration. In FIG. 2, for the purpose of illustration, the internal configuration of the part located in the sheet right side of the center axis CX is depicted by a dashed line, and the schematic drawing illustrating a state before the ground electrode 20 is mounted to a metal shell 50 is depicted within the balloon of FIG. 2.

The spark plug 100 (FIG. 1) is mounted in a combustion chamber of an internal combustion engine and used for ignition thereof. In the spark plug 100, the front end side depicted in the sheet lower side is arranged in the combustion chamber and the rear end side depicted in the sheet upper side is arranged outside the combustion chamber.

The spark plug 100 has a center electrode 10, the ground electrode 20, an insulator 30, a terminal electrode 40, and the metal shell 50. The center electrode 10 is configured with a shaft-like electrode member extending in the center axis direction that is the axial line direction. The center electrode 10 is accommodated in the front end side within a cylinder hole 51 of the metal shell 50 with its front end part 11 projecting out of an axial hole 31 of the insulator 30. The center electrode 10 is arranged such that its center axis matches the center axis CX of the spark plug 100. The center electrode 10 is electrically connected to an external power source via the terminal electrode 40 held in the rear end side in the axial hole 31 of the insulator 30.

The ground electrode 20 is an annular metallic member joined to the front end part of the metal shell 50 and, for example, made of a nickel (Ni) alloy. The ground electrode 20 corresponds to a narrower term of the front end member in the present invention. The ground electrode 20 has an annular part 21 and two protrusion parts 22*a* and 22*b*. The annular part 21 is substantially an annular part having an opening 23 opened in the center axis direction at the center. The annular part 21 is joined to the opening end part in the front end side of the metal shell 50. The details of this point will be described later.

The two protrusion parts 22*a* and 22*b* protrude toward the front end side on a face in the front end side of the annular part 21. The two protrusion parts 22*a* and 22*b* are provided to the positions facing to each other interposing the center axis CX, and extend bending toward the center axis CX, respectively. A spark gap SG that is a predetermined gap for generating a spark discharge is provided between each of the protrusion parts 22*a* and 22*b* and the front end part 11 of the center electrode 10. The two protrusion parts 22*a* and 22*b* may be formed by a cutting, or may be formed by a forging.

The insulator 30 (FIG. 1) is a shaft-like member having the axial hole 31 penetrating its center and made of a ceramic sintered material such as alumina, aluminum nitride, and the like, for example. The insulator 30 has a step face 35 and a flange part 36 at the part in the front end side. The step face 35 is an annular face that is formed by reducing the diameter of the front end side in the insulator 30 and faces the front end side. The flange part 36 is an annular part that is located in the rear end side of the step face 35, has a locally larger diameter than the remaining part, and protrudes in the radial direction of the insulator 30, that is, in the direction orthogonal to the center axis CX. The insulator 30 is held by the metal shell 50 such that its center axis matches the center axis CX of the spark plug 100 and that the part of the insulator 30 in the rear end side of the flange part 36 extends out of the rear end side opening part of the metal shell 50.

The center electrode 10 is held within the axial hole 31 in the front end side of the insulator 30 as described above. The terminal electrode 40 that is a shaft-like electrode member is held within the axial hole 31 in the rear end side of the insulator 30. The rear end part 41 of the terminal electrode 40 extends out of the rear end opening of the insulator 30 so as to be connectable to the external power source. A resistor 45 is arranged between the center electrode 10 and the terminal electrode 40 within the axial hole 31 of the insulator 30. First and second glass seal members 46 and 47 are arranged to the front end side and the rear end side of the resistor 45, respectively. In this way, the center electrode 10 and the terminal electrode 40 are electrically connected to each other via the resistor 45 interposed between the first and second glass seal members 46 and 47. This suppresses the occurrence of the radio noise at the generation of the spark discharge in the spark plug 100.

The metal shell 50 is substantially a cylindrical member having a cylinder hole 51 at the center and forms a housing of the spark plug 100. It is preferable that the metal shell 50 is made of a metallic material having a high workability. The metal shell 50 is made of metal such as a carbon steel and the like, for example. The insulator 30 is accommodated in the cylinder hole 51 of the metal shell 50. The center axis of the metal shell 50 matches the center axis CX of the spark plug 100.

In the followings, the part in the front end side in the metal shell 50 is referred to as "front-end-side part 50*a*" and the part in the rear end side in the metal shell 50 as "rear-end-side part 50*b*." In the outer circumference surface of the front-end-side part 50*a*, a screw part 52*s* provided with thread grooves for fixing the spark plug 100 to the internal combustion engine is formed. In the rear-end-side part 50*b*, a crimp part 54 for fixing the insulator 30 to the opening end part in the rear end side is provided. The crimp part 54 is formed by that the opening end part in the rear end side in the rear-end-side part 50*b* is crimped inward under a state that the flange part 36 of the insulator 30 has been accommodated in the cylinder hole 51 and the front end part of the insulator 30 has been engaged to a protrusion part 53 within the cylinder hole 51. A talc layer 70 filled with talc powder and ring-shaped line packings 71 and 72 are arranged between the inner wall face of the crimp part 54 and the rear-end-side face of the flange part 36 of the insulator 30. This ensures the airtightness between the metal shell 50 and the insulator 30.

The rear-end-side part 50*b* further has a tool engagement part 56, a thin part 57, and a flange part 58 in this order from the rear end side. The tool engagement part 56 is a part having a hexagonal cross section protruding in the radial direction and is formed in the position neighboring the crimp part 54. The tool engagement part 56 is a part to which a tool such as a spanner and the like is engaged when the spark plug 100 is mounted to the internal combustion engine. The thin part 57 is a part between the tool engagement part 56 and the flange part 58 and having a thinnest thickness in the metal shell 50. The thin part 57 is slightly bent outward by the external force applied to the metal shell 50 when the crimp part 54 is formed.

The flange part 58 is an annular part protruding in the radial direction of the metal shell 50, that is, in the direction orthogonal to the center axis CX and is formed in the front end side of the rear-end-side part 50*b*. The flange part 58 is arranged outside the combustion chamber when the spark plug 100 is mounted to the internal combustion engine. A gasket 73 is arranged on a face in the front end side of the flange part 58. When the spark plug 100 is mounted to the internal combustion engine, the gasket 73 is pressed and collapsed by the flange part 58 to provide a seal between the combustion chamber and the metal shell 50.

The ground electrode 20 is mounted to the front end part of the metal shell 50 as follows. In the rear end face side of the annular part 21 of the ground electrode 20, a step part 62 in which the diameter of the annular part 21 decreases stepwise toward the rear end side is formed (FIG. 2). On the other hand, in the inner circumference side of the opening end part in the front-end-side part 50*a*, a step part 59 in which the opening diameter of the cylinder hole 51 decreases stepwise toward the rear end side is formed. The diameter of the rear end side in the step part 62 of the annular part 21 is substantially the same as the opening diameter of the front end side in the step part 59 of the front-end-side part 50*a*. Further, the diameter in the front end side of the step part 62 of the annular part 21 is substantially the same as the outer circumference diameter in the opening end part in the front end side of the front-end-side part 50*a*. The step part 62 of the annular part 21 and the step part 59 of the front-end-side part 50*a* are fit each other.

The end face of the front end side in the opening end part of the front-end-side part 50*a* is referred to as "front end opening end face 59*s*." Further, substantially the annular face formed in the outermost circumference of the annular part 21 in the ground electrode 20 and facing the rear end side is referred to as "outer circumference annular face 62*s*." When the ground electrode 20 is mounted in the opening part of the front-end-side part 50*a*, the front end opening end face 59*s* of the front-end-side part 50*a* and the outer circumference annular face 62*s* of the ground electrode 20 are in surface-contact with each other. In the followings, the boundary of these two faces 59*s* and 62*s* is referred to as "boundary part WB."

In the outer circumference end of the boundary part WB between the front-end-side part 50*a* and the ground electrode 20, a weld portion 5 is formed in which the component material of the ground electrode 20 and the component material of the metal shell 50 are mutually melted by a leaser welding. The weld portion 5 is formed so as to be continuous in an annular manner over the entire outer circumference end part of the ground electrode 20.

[Welding of the Ground Electrode to the Metal Shell]

Figure 3:
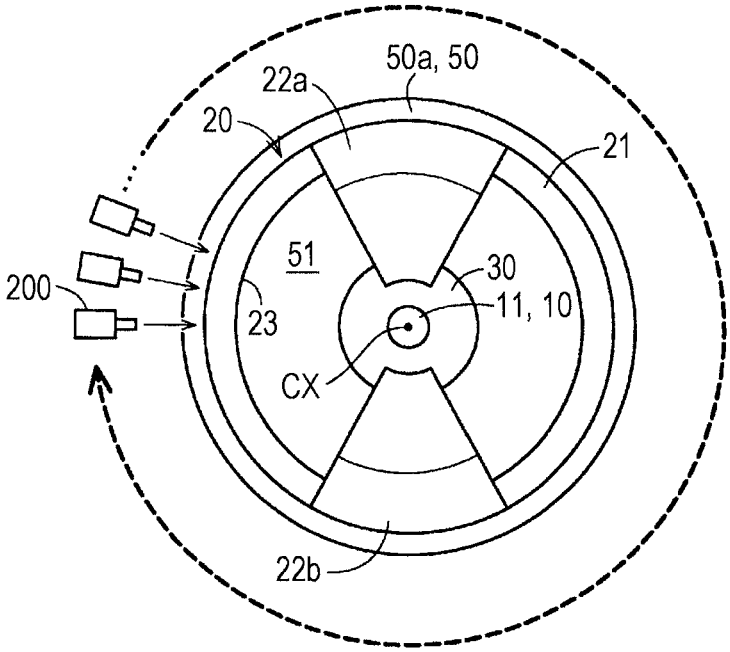
FIG. 3 is a schematic diagram for illustrating a welding process of a front end member to a metal shell.

FIG. 3 is a schematic diagram for illustrating a welding process of the ground electrode 20 to the metal shell 50. FIG. 3 depicts a schematic drawing of the ground electrode 20 fitted to the opening of the front-end-side part 50*a* when viewed in the center axis direction from the front end side. Further, FIG. 3 schematically depicts a movement trace of a laser irradiation unit 200 in the welding process.

In the welding process of the ground electrode 20 to the metal shell 50, the laser irradiation unit 200 of a laser welding apparatus moves at a predetermined pitch along the outer circumference end part of the annular part 21 in the ground electrode 20. The laser irradiation unit 200 irradiates the laser at a predetermined output in each set position during one round around the annular part 21. This causes the weld portion 5 to be formed over the entire outer circumference of the ground electrode 20. In the welding process of the present embodiment, in the last part of the irradiation processes in the entire laser irradiation process for forming the entirety of the weld portion 5, the laser output is reduced from the rest irradiation processes. The details thereof will be described later.

Figure 4:
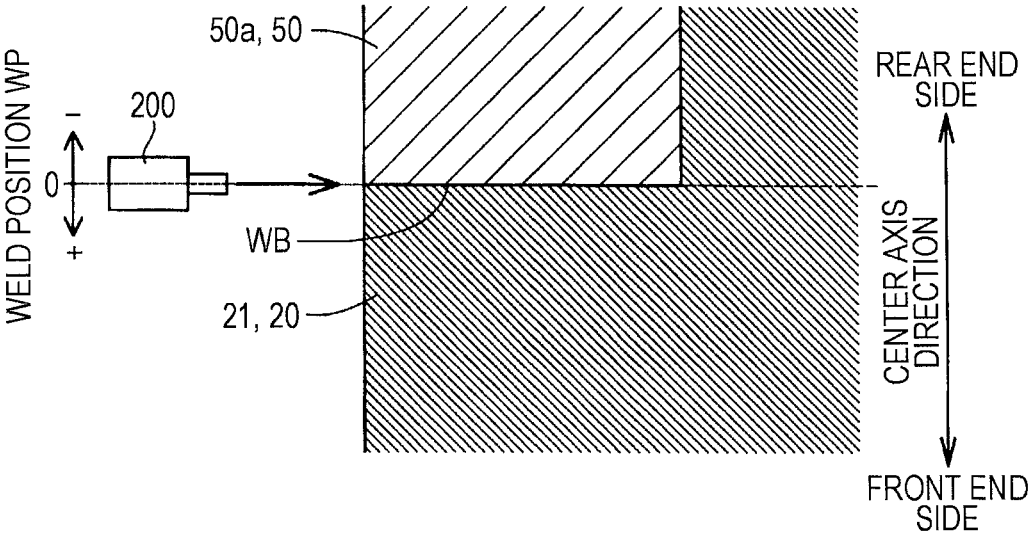
FIG. 4 is a schematic diagram for illustrating a weld position by a laser irradiation unit in a center axis direction.

FIG. 4 is a schematic diagram for illustrating a weld position by the laser irradiation unit 200 in the center axis direction. FIG. 4 depicts a schematic sectional diagram around the boundary part WB between the annular part 21 of the ground electrode 20 and the front-end-side part 50*a* of the metal shell 50 before the laser welding and a position of the laser irradiation unit 200 at the laser welding, when viewed in the direction orthogonal to the center axis direction. In the outer circumference side surface in the boundary part WB before the laser welding, substantially no step occurs between the front-end-side part 50*a* and the annular part 21. The laser irradiation unit 200 irradiates the outer circumference surface in the boundary part WB with the laser in the direction substantially orthogonal thereto, that is, in the direction substantially orthogonal to the center axis CX.

In the present specification, the position in the center axis direction of the laser irradiation unit 200 at the laser irradiation is referred to as "weld position WP." The weld position WP is represented by a distance in the center axis direction between the laser irradiation unit 200 and the boundary part WB. The weld position WP is zero when the laser irradiation unit 200 is located at the same position as the boundary part WB in the center axis direction, as depicted. Further, the weld position WP is plus when the laser irradiation unit 200 is located in the front end side of the boundary part WB, while it is minus when the laser irradiation unit 200 is located in the rear end side of the boundary part WB.

In the present embodiment, when the weld portion 5 is formed, the weld position WP is set to the same in every laser irradiation process. In order to ensure the joining quality of the ground electrode 20 to the metal shell 50, the weld position WP is preferably between −0.2 mm to 0.2 mm, more preferably between −0.1 mm to 0.1 mm.

Figure 5:
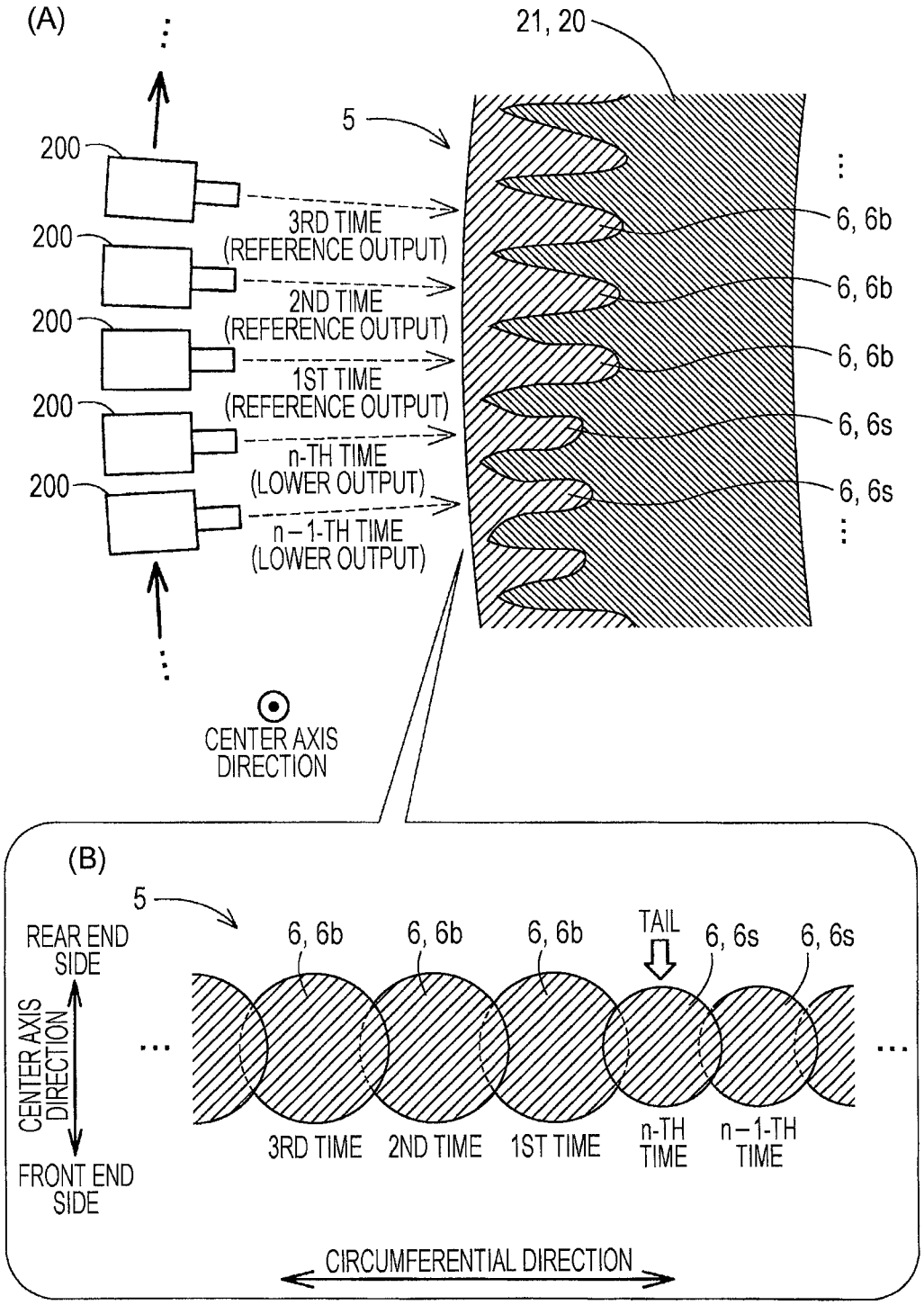
FIG. 5 is a schematic diagram for illustrating a configuration of a weld portion formed by laser irradiations by means of the laser irradiation unit.

FIG. 5 is a schematic diagram for illustrating a configuration of the weld portion 5 formed by the laser irradiation by means of the laser irradiation unit 200. The section (A) of FIG. 5 schematically depicts a schematic cross section of a part of the weld portion 5 in the cross section orthogonal to the center axis direction and a laser irradiation position by the laser irradiation unit 200 when the weld portion 5 is formed. FIG. 5 depicts the first to third laser irradiation positions and the last n−1-th to n-th laser irradiation positions when the laser irradiations are applied for n times in order to form an annularly continuous weld portion 5. Here, n is a natural number around 90 to 150.

The annularly continuous weld portion 5 is formed by applying the laser irradiation processes for around 90 to 150 times with changing the irradiation position of the laser irradiation unit 200 for each time. Melt extending parts 6 each extending toward the inner circumference side in the radial direction of the front-end-side part 50*a* and the annular part 21 are formed to each part irradiated with the laser by the laser irradiation unit 200. The weld portion 5 is formed by that the outer-circumference-side end parts of the neighboring melt extending parts 6 are overlapped and connected to each other.

The weld portion 5 of the present embodiment partially includes the melt extending part 6 whose depth of the melting is smaller than others. In the followings, the melt extending part 6 whose depth of the melting is smaller than others is referred to as "smaller melt extending part 6*s*" in particular, and the melt extending part 6 other than the smaller melt extending part 6*s* is referred to as "reference melt extending part 6*b*." The depths of the melting of respective reference melt extending parts 6*b* are uniform in the extent that they are included within the difference range of around ±10%. The smaller melt extending part 6*s* is formed by a lower output laser whose output is reduced by, for example, around 70 to 90% from the laser output in forming the reference melt extending part 6*b*. In the followings, the laser output in forming the reference melt extending part 6*b* is referred to as "reference output." Further, the process of the lower output laser irradiation of the welding process for forming the weld portion 5 is also referred to as "lower output laser irradiation process."

The inventors of the present invention have obtained the following findings experimentally regarding the welding process of the ground electrode 20. The rate of the significantly expanded weld bead being formed can be reduced by providing the lower output laser irradiation process in a part of the laser irradiation process such that the smaller melt extending part 6*s* is properly included in a part of the weld portion 5. In particular, with providing the lower output laser irradiation process in the last of the welding process such that the smaller melt extending part 6*s* is formed to be continuous to the tail part neighboring the first formed melt extending part 6 in the welding process, the rate of the significant expansion of the weld bead occurring at the last of the welding process can be reduced.

In the weld portion 5 of the present embodiment, multiple times of the lower output laser irradiation process are provided in the last of the welding process, so that a plurality of smaller melt extending parts 6*s* are formed continuously to the tail part of the weld portion 5. This suppresses the occurrence of the significant expansion of the weld bead near the n-th laser irradiation position. In the formed weld portion 5, the tail part at which the last laser irradiation has been made can be identified as follows.

The section (B) in the balloon of FIG. 5 schematically depicts the welded mark of the weld portion 5 depicted in the section (A) of FIG. 5. As described above, the weld portion 5 is formed by that the outer-circumference-side end parts of the neighboring melt extending parts 6 overlap to continue in an annular manner. When respective melt extending parts 6 are sequentially formed by the laser irradiation, the circumference contour of substantially the circular welded mark of the immediately previously formed melt extending part 6 is erased by the circumference contour of the welded mark of the subsequently formed melt extending part 6. Therefore, in the surface of the weld portion 5, the circumference contour of the previously formed welded mark is in a state of being partially cut by the welded mark which has been subsequently overlapped and formed. In the tail melt extending part 6 formed by the last laser irradiation, however, the circumference contour of the welded mark is maintained in the shape of substantially the circle because of no melt extending part 6 which is subsequently overlapped and formed. Therefore, by checking the circumference contour of the welded mark of each melt extending part 6 on the surface of the weld portion 5, the welded mark without the overlapped mark of the subsequent welding can be identified to be the tail part at which the last laser irradiation has been made.

It is desirable that the ground electrode 20 be joined to the metal shell 50 at a higher welding strength in order to suppress the removal from the metal shell 50. The inventors of the present invention have found that, with the weld portion 5 being formed as follows in a later-described predetermined cross section MS, a high welding strength between the ground electrode 20 and the metal shell 50 can be ensured even when the smaller melt extending part 6*s* is included in a part of the weld portion 5.

Figure 6:
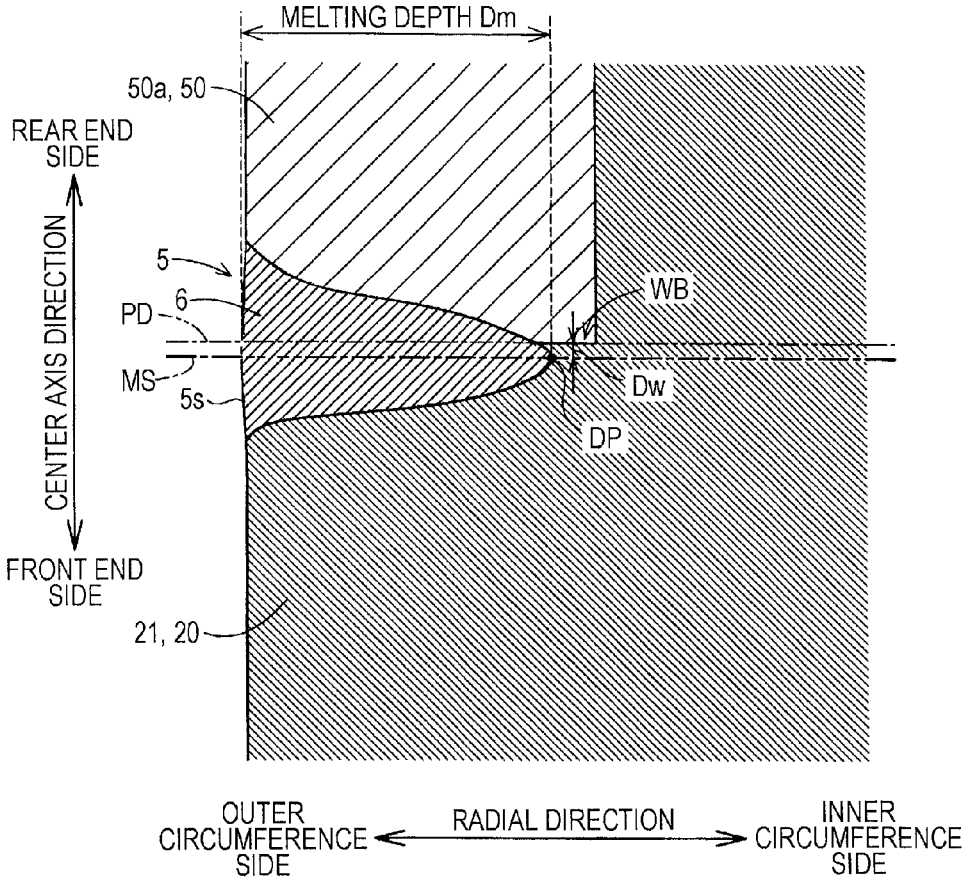
FIG. 6 is a schematic drawing illustrating a position of a predetermined cross section for defining the weld portion.

FIG. 6 is a schematic drawing illustrating the position of the predetermined cross section MS for defining the weld portion 5. FIG. 6 depicts a schematic cross section of the part around the boundary part WB between the ground electrode 20 and the front-end-side part 50*a* after the weld portion 5 has been formed, when viewed from the direction orthogonal to the center axis direction. In FIG. 6, a cut line indicating the position of the predetermined cross section MS is depicted by a dot chain line and a cut line indicating the position of a virtual plane PD (described later) is depicted by a two-dot chain line.

The predetermined cross section MS is a cross section that is orthogonal to the center axis direction and passes through a vertex DP of the melt extending part 6 at which the melting depth Dm is the greatest of all the melt extending parts 6 of the weld portion 5. Here, the "melting depth Dm" of the melt extending part 6 refers to a distance between a surface 5*s* of the weld portion 5 and the vertex DP of the melt extending part 6. The "vertex DP of the melt extending part 6" is a part which is furthest in the radial direction from the surface 5*s* of the weld portion 5 in that melt extending part 6.

Figure 7:
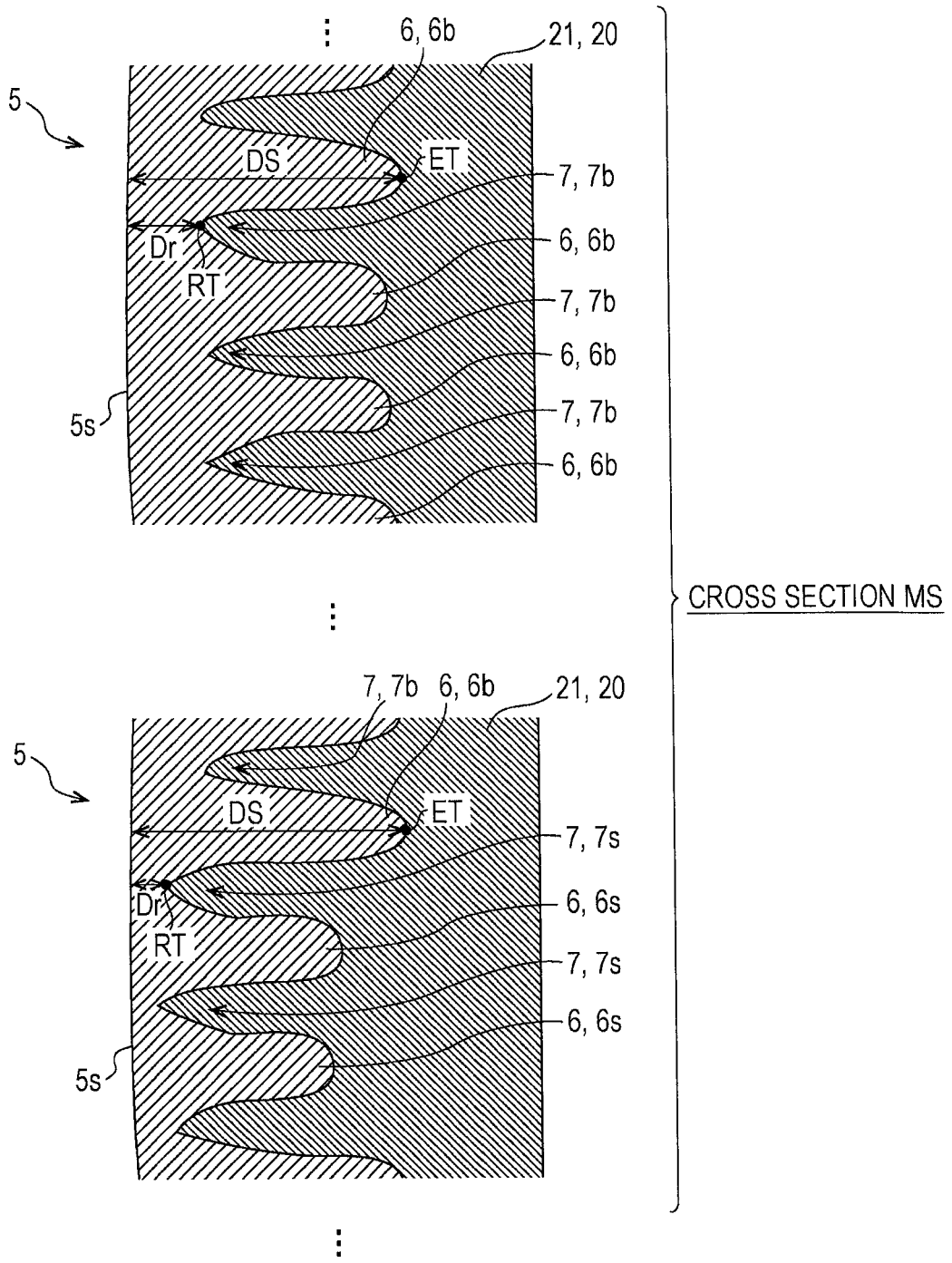
FIG. 7 is a schematic drawing for illustrating a configuration in the predetermined cross section of the weld portion.

FIG. 7 is a schematic drawing illustrating an example of the cross section configuration in the predetermined cross section MS of the weld portion 5 of the present embodiment. FIG. 7 depicts two different parts included in the predetermined cross section MS that is a cross section indicated by the dot chain cut line in FIG. 6. Specifically, the upper part of the drawing sheet of FIG. 7 depicts the part not including the smaller melt extending part 6*s* of the weld portion 5 and the lower part of the drawing sheet depicts the part including the reference melt extending part 6*b* and the smaller melt extending part 6*s* of the weld portion 5. The cross section of the annular part 21 of the ground electrode 20 is included in the predetermined cross section MS in the example of FIG. 7, however, when the predetermined cross section MS is located in the front-end-side part 50*a* side of the boundary part WB, it will not be the cross section of the annular part 21 in the ground electrode 20 but the cross section of the front-end-side part 50*a* that is included in the predetermined cross section MS.

In the followings, the part of the valley where the melting depth between the neighboring melt extending parts 6 in the weld portion 5 is shallow is referred to as "melt valley part 7." Further, a distance Dr between a vertex RT of each melt valley part 7 in the predetermined cross section MS, which is the part at which the distance to the surface of the weld portion 5 is smallest, and the surface 5*s* of the weld portion 5 is referred to as "melt distance Dr of the melt valley part 7." A distance Ds between a vertex ET of the melt extending part 6 in the predetermined cross section MS, which is the part at which the distance to the surface 5*s* of the weld portion 5 is largest, and the surface 5*s* of the weld portion 5 is referred to as "melt distance Ds of the melt extending part 6."

The inventors of the present invention has obtained the findings experimentally that the melt valley part 7 having the melt distance Dr that is 15% or greater of the average of the melt distances Ds of all the melt extending parts 6 allows for a greater contribution to the improvement of the welding strength. Here, of the melt valley parts 7, those in which the melt distance Dr is 15% or greater of the average of the melt distances Ds of all the melt extending part 6 is referred to as "larger melt valley part 7*b*", and the rest is referred to as "smaller melt valley part 7*s*."

In the weld portion 5 of the present embodiment, the larger melt valley part 7*b* occupies 80% or more of all the melt valley parts 7 in the predetermined cross section MS. The larger melt valley parts 7*b* are formed mainly in the position neighboring the reference melt extending parts 6*b*, and the smaller melt valley parts 7*s* are formed mainly in the position neighboring the smaller melt extending parts 6*s*. In the weld portion 5 of the present embodiment, the occupancy ratio of the larger melt valley parts 7*b* of the melt valley parts 7 is ensured, which suppresses the significantly increased occupancy ratio of the smaller melt extending parts 6*s* and the smaller melt valley parts 7*s*, so that the welding strength of the weld portion 5 is ensured.

Example 1

FIG. 8 is an illustration indicating an experiment result of an experiment in which the welding strength of the ground electrode 20 and the metal shell 50 was examined. In this verification experiment, a welding strength test was made to test samples (samples S01 to S06) of the metal shell 50 to which the ground electrode 20 was laser-welded. The weld portion 5 of each of the samples S01 to S06 was formed by changing a ratio of the lower output laser processes that is a ratio of the irradiation times of the lower output laser to all the laser irradiation times (125 times). The lower output laser irradiation processes were performed continuously at the last of the welding process in all the samples S01 to S06. It is noted that, in each of the samples S01 to S06, an annular convex part protruding inward in the radial direction was provided in the inner-circumference-side face of the ground electrode 20. This convex part is a part for applying weight in the welding strength test described later.

In the welding strength test for each of the samples S01 to S06, a tension tester (load capacity: 50 kN) was used to apply the weight to the above-described convex part of the ground electrode 20 at a cross head speed of 5 mm/min in the direction toward the front end side in the center axis direction. As a result, in the samples S01 to S05 in which the ratio of the lower output laser processes is less than or equal to 20%, the welding strength exceeding 7600 N was ensured and no reduction of the welding strength was observed. On the other hand, in the sample S06 in which the ratio of the lower output laser process is greater than 20%, the welding strength of 7600 N or less only was obtained and the reduction of the welding strength was observed.

In all of the samples S01 to S06, the occupancy ratio of the smaller melt valley parts 7*s* in all the melt valley parts 7 in the predetermined cross section MS substantially matched the ratio of the lower output laser process in the welding process. The occupancy ratio of the larger melt valley parts 7*b* to all the melt valley parts 7 in the predetermined cross section MS was greater than or equal to 80% in the samples S01 to S05, while it was less than 80% in the sample S06. As such, it was confirmed that the weld portion 5 in which the occupancy ratio of the larger melt valley parts 7*b* in all the melt valley parts 7 in the predetermined cross section MS is greater than or equal to 80% allows for ensuring the welding strength of the ground electrode 20 to the metal shell 50.

Example 2

FIG. 9 is an illustration indicating an experiment result of an experiment in which the occurrence rate of the weld bead expansion in the welding process for forming the weld portion 5 was examined. In this verification experiment, the weld portion 5 was formed for multiple times for respective welding conditions, and the occurrence rate of the weld bead expansion having a predetermined size or larger was examined.

As the welding conditions, set were the ratio of the lower output laser processes in the welding process and a reduction ratio of the laser output that is a ratio by which the laser output is reduced from the reference output in the lower output laser irradiation process. It is noted that, also in this verification experiment, the lower output laser irradiation processes were performed continuously in the last of the welding process. The ratio of the lower output laser processes in the welding process substantially matched the ratio of the range where the smaller melt valley parts 7*s* were formed in the entire circumference of the weld portion 5 in the predetermined cross section MS.

The ratio (percentage) of the melt distance Ds of the smaller melt extending parts 6*s* to the average of the melt distances Ds of all the melt extending parts 6 in the predetermined cross section MS is referred to as "extending part reduction degree." In this verification experiment, the value of the extending part reduction degree decreased as the reduction ratio of the laser output increased. The table of FIG. 9 indicates the values of the extending part reduction degree.

From the result of this verification experiment, the followings are understood. In the predetermined cross section MS, when the smaller melt extending parts 6*s* are formed over the range that is continuous for 2% or greater of the entire circumference of the weld portion 5, it is preferable that the weld portion 5 is formed such that the extending part reduction degree RD is greater than or equal to 35% and less than or equal to 96% (35%≤RD≤96%). In the weld portion 5 formed in such a way, the occurrence rate of the weld bead expansion was suppressed to 50% or less, and the evaluation of "A" or "B" was obtained.

When the smaller melt extending parts 6*s* are formed over the range that is continuous for 6% or greater of the entire circumference of the weld portion 5, it is preferable that the weld portion 5 is formed such that the extending part reduction degree RD is greater than or equal to 72% and less than or equal to 86% (72%≤RD≤86%). In the weld portion 5 formed in such a way, the occurrence rate of the weld bead expansion was suppressed to 30% or less, and the evaluation of "A" was obtained. On the other hand, when the smaller melt extending parts 6*s* are formed over the range that is continuous for 5% or less of the entire circumference of the weld portion 5, it is preferable that the extending part reduction degree RD is around 72% (RD=72%). In the weld portion 5 formed in such a way, the occurrence rate of the weld bead expansion was suppressed to 30% or less, and the evaluation of "A" was obtained.

Example 3

FIG. 10 is an illustration indicating an experiment result of an experiment in which the weld position WP and the laser reference output suitable for forming the weld portion 5 were examined. In this verification experiment, the welding strength and the appearance state when the weld portion 5 is formed by changing the weld position WP (FIG. 4) and the laser reference output were examined. The welding strength was measured by the same process as described in FIG. 8. The appearance state is evaluated by measuring the number of the generated spatters by visual inspection. The ratio of the lower output laser processes was 20%, and the laser output in the laser output reduction process was around 80 to 90% of the reference output.

From the result of the verification experiment, the range of the weld position WP suitable for forming the weld portion 5 and the range of the laser reference output are as follows. It is preferable that the weld position WP is greater than or equal to −0.2 mm and less than or equal to 0.2 mm (−0.2 mm≤WP≤0.2 mm) Further, it is preferable that the laser reference output LS is greater than or equal to 1200 W and less than or equal to 1600 W (1200 W≤LS≤1600 W). In the verification experiment, when the weld position WP and the laser reference output LS were within the above-described range, the welding strength of 8000 N or greater was ensured, and the number of the generated spatters was suppressed to 10 or less.

The vertex DP (FIG. 6) of each melt extending part 6 of the weld portion 5 is formed, in general, to the weld position WP when that melt extending part 6 is formed. Therefore, from the result of the verification experiment, it can be said that the vertex DP of each melt extending part 6 is preferably within the range where the distance Dw in the center axis direction to the virtual plane PD (depicted by a two-dot chain line) including the boundary part WB is less than or equal to 0.2 mm.

Example 4

Figures 11, 12:
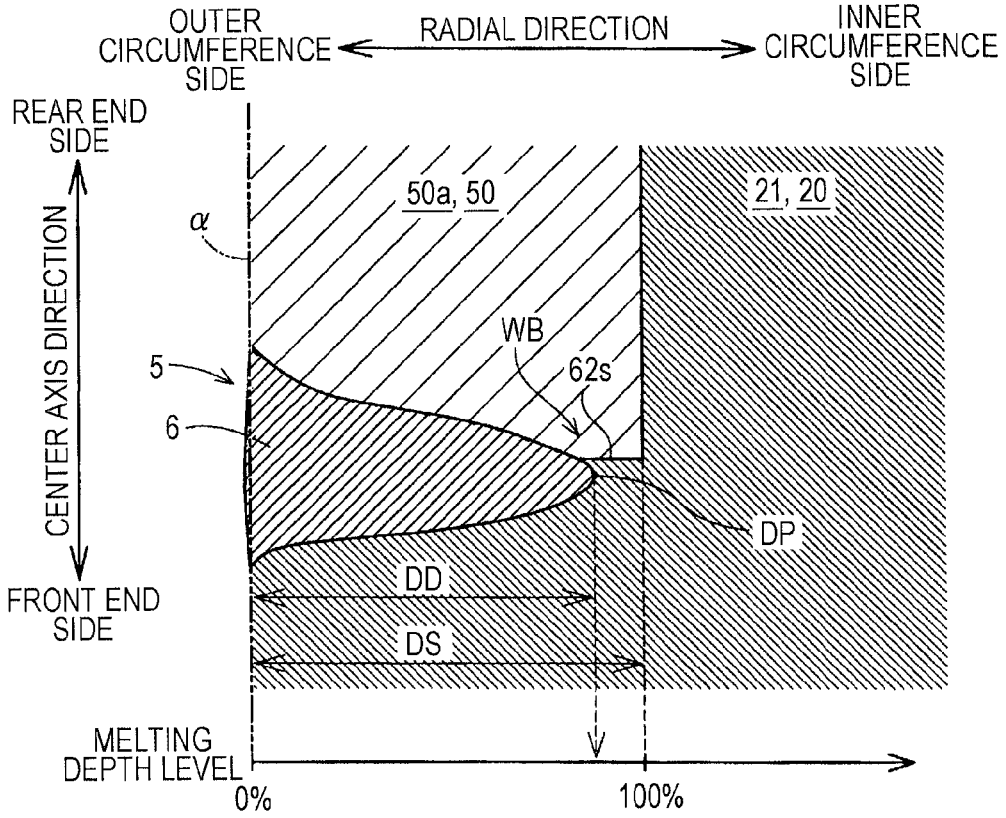
FIG. 11 is an illustration indicating a result in which a relationship between the weld position and laser reference output and a degree of the melting depth of a reference melt extending part was examined.
FIG. 12 is an illustration for illustrating "melting depth level"

FIG. 11 is an illustration indicating a result in which the relationship between the weld position WP and laser reference output LS and the degree of the melting depth of a reference melt extending part 6*b* was examined. FIG. 11 illustrates a table in which the measured result of "melting depth level" indicating the degree of the melting depth of the reference melt extending part 6*b* is listed for the weld portion 5 formed by the weld position WP and the laser reference output LS within the suitable range described in FIG. 10.

FIG. 12 is an illustration for illustrating the "melting depth level" on the table of FIG. 11. FIG. 12 depicts a schematic sectional drawing in the cross section defined by the vertex DP and the center axis CX with respect to any melt extending part 6. A plane defined by the outer-circumference-side face of the annular part 21 in the ground electrode 20 is referred to as "reference plane α" and the distance between the reference plane α and the vertex DP of the melt extending part 6 is referred to as "melting distance DD."

The melting depth level is a ratio of the melting distance DD with respect to the distance DS from the reference plane α to the end part of the inner circumference side in the outer circumference annular face 62*s* of the annular part 21 included in the boundary part WB. Therefore, the melting depth level exceeding 100% means that the melt extending part 6 reaches the position exceeding the end part of the inner circumference side of the outer circumference annular face 62*s*.

When the weld position WP was −0.2 mm≤WP≤0.2 mm and the laser reference output LS was LS≥1200 W, each melting depth level of the reference melt extending part 6*b* was 90% or greater (FIG. 11). Further, when the laser reference output LS was LS≥1400 W, the melting depth level of the reference melt extending part 6*b* was 120% or greater regardless of the weld position WP.

Figure 13:
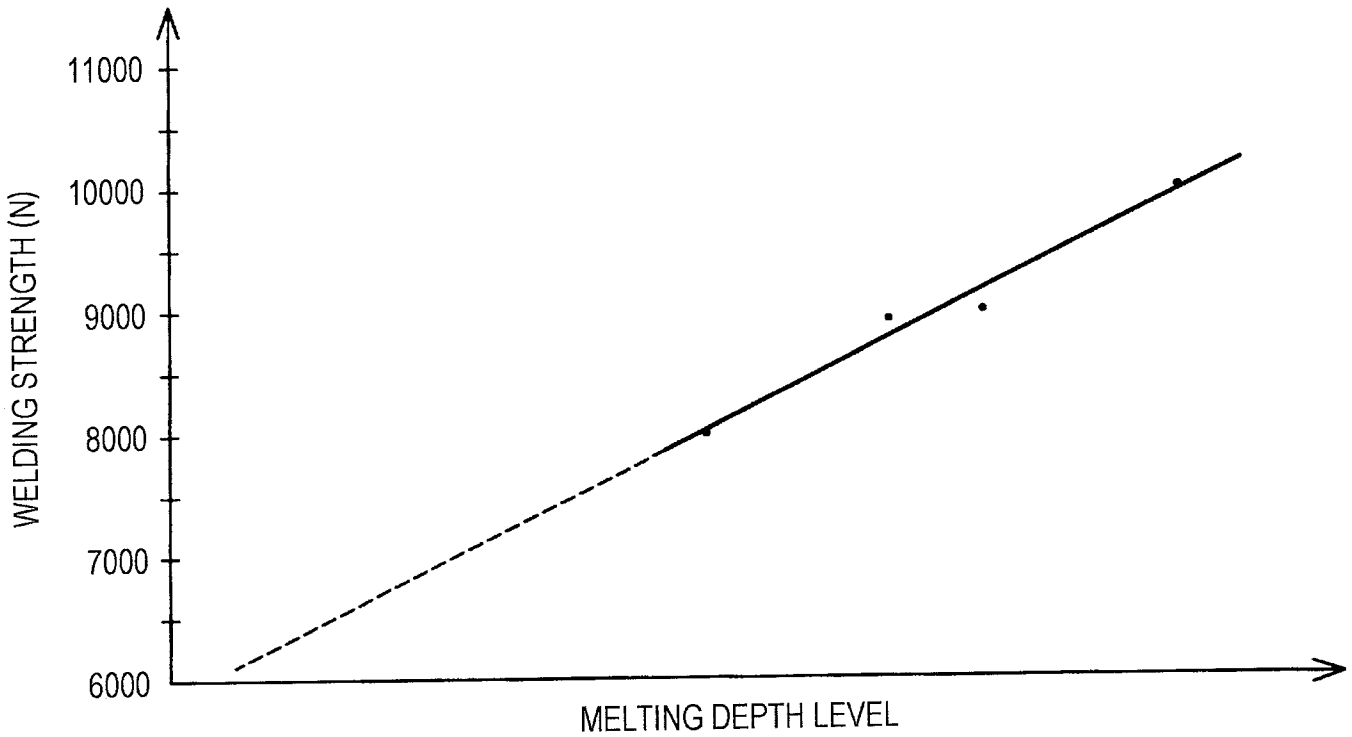
FIG. 13 is an illustration for illustrating a relationship between a welding strength due to the weld portion and the melting depth level.

FIG. 13 is an illustration for illustrating the relationship between the welding strength of the weld portion 5 and the melting depth level of the reference melt extending part 6*b*. FIG. 13 depicts a graph in which the horizontal axis represents the melting depth level and the vertical axis represents the welding strength. This graph indicates that, when the melting depth level of the reference melt extending part 6*b* is 90% or greater, there is a linear relationship between the welding strength of the weld portion 5 and the melting depth level of the reference melt extending part 6*b* that a greater melting depth level results in a greater welding strength. It is also indicated that, with the melting depth level of the reference melt extending part 6*b* being 90% or greater, the welding strength of 8000 N or greater is ensured.

In this way, with the weld position WP being −0.2 mm≤WP≤0.2 mm and the laser reference output LS being LS≥1200 W, the welding strength of 8000 N or greater is ensured. That is, when the vertex DT of the reference melt extending part 6*b* is within the range where the distance from the boundary part WB is 0.2 mm or less and the melting depth level of the reference melt extending part 6*b* is 90% or greater, the welding strength of 8000 N or greater is ensured.

As set forth, according to the spark plug 100 of the present embodiment, the smaller melt extending parts 6*s* are included in a part of the weld portion 5 and, thereby, the occurrence of the weld bead expansion in the weld portion 5 is suppressed. Further, the larger melt valley parts 7*b* are included in the weld portion 5 at a proper ratio, so that the welding strength between the metal shell 50 and the ground electrode 20 is ensured.

B. Second Embodiment

Figure 14:
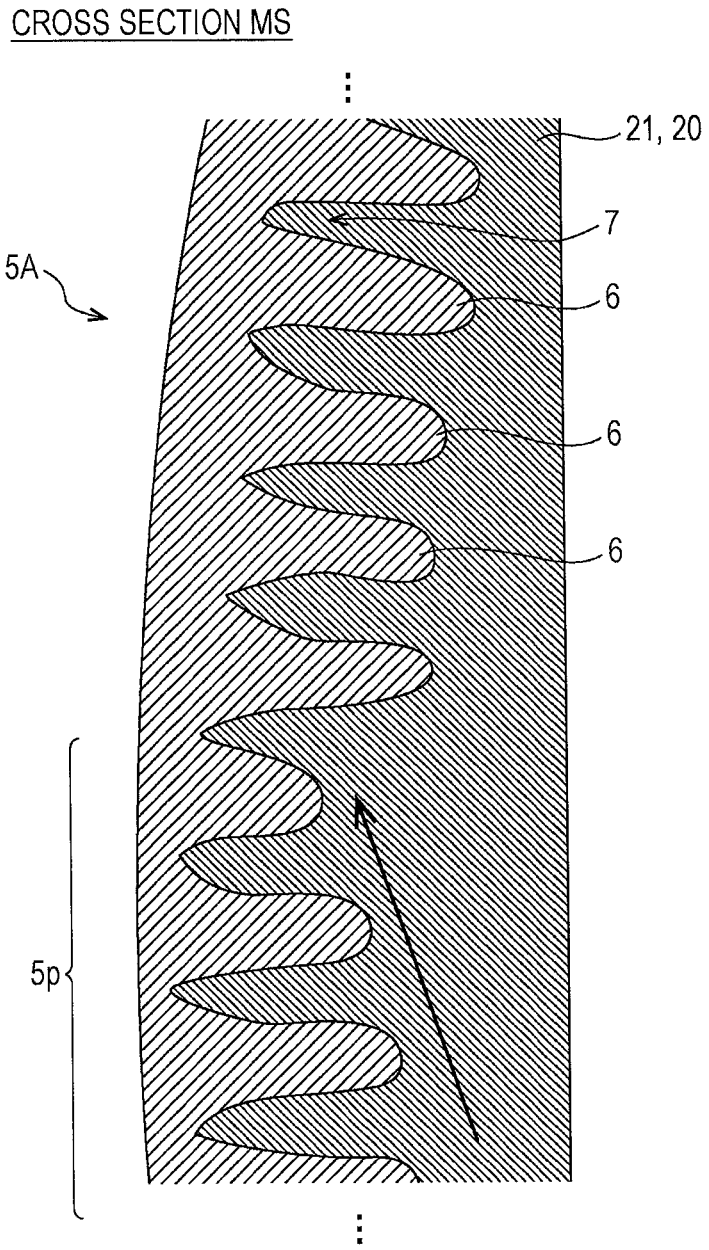
FIG. 14 is a schematic diagram for illustrating a welding process as a second embodiment.

FIG. 14 is a schematic drawing illustrating an example of a cross section configuration of a weld portion 5A of a spark plug as a second embodiment of the present invention. FIG. 14 depicts a part of the weld portion 5A included in the predetermined cross section MS. The spark plug of the second embodiment has substantially the same configuration as the spark plug 100 described in the first embodiment except that the configuration of the weld portion 5A is different (FIG. 1, FIG. 2). Further, the predetermined cross section MS is a cross section at the same position as that described in the first embodiment (FIG. 6).

The weld portion 5A of the second embodiment has the melt extending parts 6 that are aligned in a line in an annular manner and in which neighboring ones are connected to each other at their ends. Except some parts 5*p* in which the melting depths gradually decrease, the melt extending parts 6 of the weld portion 5A of the second embodiment are substantially uniform such that the melting depth is within the range with the difference of around ±10%.

The weld portion 5A of the second embodiment partially has the parts 5*p* in which the melting depths of the melt extending parts 6 gradually decrease and, thereby, the occurrence of the significant expansion of the weld bead is suppressed similarly to the weld portion 5 of the first embodiment. Further, in the weld portion 5A of the second embodiment, the larger melt valley part 7*b* occupies 80% of all the melt valley parts 7 in the predetermined cross section MS similarly to the weld portion 5 of the first embodiment. Thereby, in the spark plug of the second embodiment, the welding strength between the metal shell 50 and the ground electrode 20 is ensured.

Figure 15:
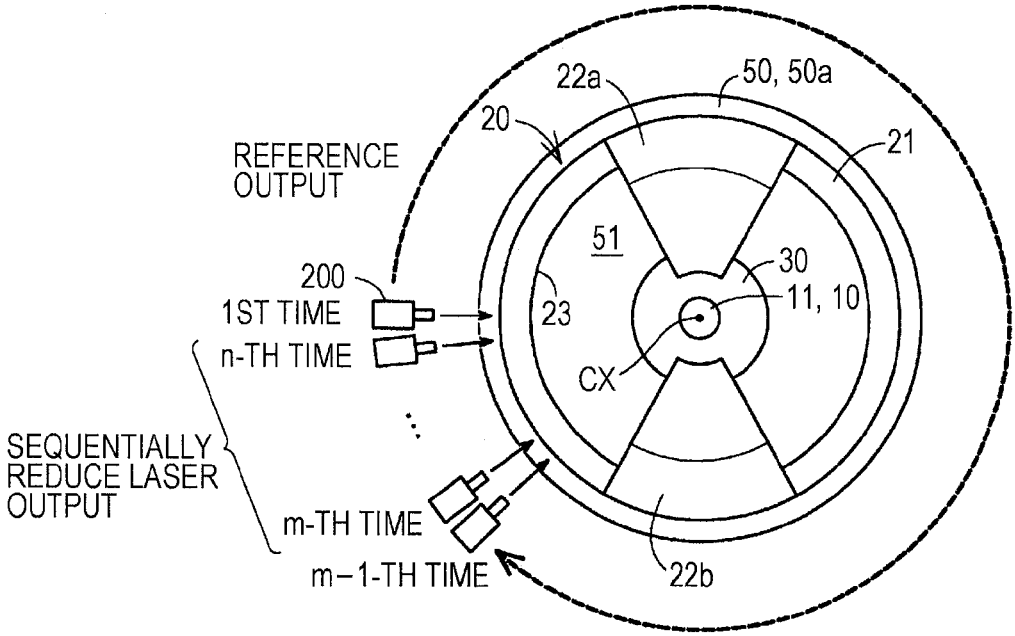
FIG. 15 is a schematic diagram for illustrating the welding process for forming the weld portion of the second embodiment.

FIG. 15 is a schematic diagram for illustrating the welding process for forming the weld portion 5A of the second embodiment. FIG. 15 depicts a schematic drawing of the ground electrode 20 fitted to the opening of the front-end-side part 50*a*, when viewed from the front end side in the center axis direction. Further, FIG. 14 schematically depicts the movement trace of the laser irradiation unit 200 in the welding process.

The weld portion 5A of the second embodiment is formed by n times of the laser irradiation processes, where n is a natural number around 90 to 150. The reference output laser is irradiated in the first to m−1-th laser irradiation processes of n times of the laser irradiation processes, where m is a natural number of m≤n×20%. Further, the laser output is sequentially reduced in the m-th to n-th laser irradiation processes. The part 5*p* in which the melting depths gradually decrease is formed to the tail part in the weld portion 5A of the second embodiment by these m-th to n-th laser irradiation processes.

EXAMPLE

FIG. 16 is an illustration for illustrating a verification experiment in which the occurrence rate of the weld bead expansion in the weld portion 5A of the second embodiment.

In this verification experiment, predetermined times of the welding processes were performed under the conditions described later, and the occurrence rate of the weld bead expansion having a predetermined size or larger was examined. In the welding process of this verification experiment, the laser irradiation processes were performed for 125 times. In 7.2% of the processes, the laser output was reduced below the reference output. Specifically, the first to 116th laser irradiation processes were performed at the reference output of 1400 W and, in the 117th to 125th laser irradiation processes, the laser output was reduced from the reference output with a decrement of 100 W. As a result, the occurrence rate of the significant expansion of the weld bead is 10% or less.

As set forth, according to the spark plug of the second embodiment, the part 5*p* in which the melting depths of the melt extending parts 6 gradually decrease is formed in a part of the weld portion 5A and, thereby, the occurrence of the significant weld bead expansion is further suppressed. Further, the welding strength between the metal shell 50 and the ground electrode 20 is ensured.

C. Modified Example

C1. Modified Example 1

In each of the above-described embodiments, the smaller melt extending parts 6*s* are formed continuously to the tail part at which the last laser irradiation has been made in the weld portions 5 and 5A. In contrast, the smaller melt extending parts 6*s* may be formed to other part than the part at which the last laser irradiation has been made, and may be formed at any part of the weld portions 5 and 5A. Further, the smaller melt extending parts 6*s* may not be formed continuously to one point. The smaller melt extending parts 6*s* may be formed continuously to a plurality of points. The smaller melt extending parts 6*s* may be formed such that a plurality of smaller melt extending parts 6*s* are scattered, respectively.

C2. Modified Example 2

In each of the above-described embodiments, the weld portions 5 and 5A are formed by causing one laser irradiation unit 200 to round the outer circumference of the annular part 21 in the ground electrode 20. In contrast, in the welding process of the ground electrode 20 to the metal shell 50, a plurality of laser irradiation units 200 may be employed to form the weld portions 5 and 5A by simultaneously starting the laser irradiation from the different positions in the outer circumference of the annular part 21, respectively. Further, in the welding process of the ground electrode 20 to the metal shell 50, a first laser irradiation unit for irradiating the reference output laser and a second laser irradiation unit for irradiating the lower output laser may be used.

C3. Modified Example 3

In each of the above-described embodiments, the ground electrode 20 is mounted as the front end member to the opening end part in the front end side of the metal shell 50. In contrast, to the opening end part in the front end side of the metal shell 50, the ground electrode having other configuration than has been described in the above-described embodiments may be mounted as the front end member, or the front end member having other function may be mounted in place of the ground electrode. The front end member may be any annular member having the opening opened in the axial line direction. The "opening opened in the axial line direction" is not limited to the opening opened in the direction parallel to the axial line direction, but includes an opening opened obliquely to the axial line direction, for example.

The present invention, also in terms of including the configuration of the insulator, the center electrode, the ground electrode, the ignition part including the spark gap, and so on, is not limited to the above-described embodiments, examples, and modified examples. The present invention is not limited to the above-described embodiments, examples, and modified examples, but can be implemented in various configurations in the scope without departing from its spirit. For example, the technical features in the embodiments, the examples, and the modified examples corresponding to the technical features in each forms described in the section of Summary of the Invention can be properly replaced and/or combined in order to solve a part of or all of the above-described problems or in order to achieve a part of or all of the above-described advantages. Further, unless those technical features are described as essential in the present specification, it or they can be properly deleted.

DESCRIPTION OF REFERENCE NUMERALS

5, 5A Weld portion
5*s* Surface
6 Melt extending part
6*b* Reference melt extending part
6*s* Smaller melt extending part
7 Melt valley part
7*b* Larger melt valley part
7*s* Smaller melt valley part
10 Center electrode
11 Front end part
20 Ground electrode
21 Annular part
22*a*, 22*b* Projection part
23 Opening
30 Insulator
31 Axial hole
35 Step face
36 Flange part
40 Terminal electrode
41 Rear end part
45 Resistor
46, 47 First and second glass seal members
50 Metal shell
50*a* Front-end-side part
50*b* Rear-end-side part
51 Cylinder hole
52 Cylinder wall part
52*d* Step face
52*s* Screw part
53 Protrusion part
54 Crimp part
56 Tool engagement part
57 Thin part
58 Flange part
59 Step part
59*s* Front end opening end face
62 Step part
62*s* Outer circumference annular face
70 Talc layer
71, 72 Line packing
73 Gasket
100 Spark plug
200 Laser irradiation unit CX Center axis
DP Vertex
ET Vertex
RT Vertex
SG Spark gap
WB Boundary part

The invention claimed is:

1. A spark plug comprising:

a center electrode extending in an axial line direction;

a cylindrical insulator accommodating the center electrode therein such that a front end part of the center electrode is exposed out of a front end side of the insulator;

a cylindrical metal shell accommodating the insulator therein;

a front end member arranged at a front end part of the metal shell and having an opening in the axial line direction; and a weld portion that is formed along an outer circumference end part of the front end member and in which the front end member and the metal shell have been mutually melted, wherein the weld portion has a plurality of melt extending parts each extending in a direction perpendicular to the axial line direction toward an inner circumference side from the outer circumference end part of the front end member, and the plurality of melt extending parts are provided aligned along the outer circumference end part of the front end member such that adjacent melt extending parts are connected to each other in an outer-circumference-side end part, and partially include a smaller melt extending part in which a melting depth Dmis smaller than other melt extending parts, said depth Dm being a distance between a vertex of the melt extending part that is a furthest part from a surface of the weld portion and the surface of the weld portion.

2. The spark plug according to claim 1, wherein the weld portion has a melt valley part between the adjacent melt extending parts, the melt valley part includes a larger melt valley part in which a distance Dr is 15% or greater than an average of all of distances Ds, where Dr is a distance between a surface of the weld portion and a vertex of the melt valley part in a cross section orthogonal to a center axis of the metal shell, said cross section passing through a vertex of the melt extending part having the largest melting depth Dm in the plurality of melt extending parts, and Ds is a distance between the surface of the weld portion and the vertex of the melt extending part in the cross section, and the larger melt valley part occupies 80% or greater of all the melt valley parts in the cross section.

3. The spark plug according to claim 2, wherein, in a continuous part of 2% or greater of an entire circumference of the weld portion, the melt distance Ds of the smaller melt extending part is configured to be 35% or greater and 96% or less of the average of all of the distances Ds in the cross section.

4. The spark plug according to claim 2, wherein, in a continuous part of 6% or greater of an entire circumference of the weld portion, the melt distance Ds of the smaller melt extending part is configured to be 72% or greater and 86% or less of the average of all of the distances Ds in the cross section.

5. The spark plug according to claim 2 further comprising:

a boundary face in which the metal shell is in surface-contact with the front end member at a more inner circumference side than the weld portion in a radial direction of the metal shell, wherein each of distances from vertexes of the plurality of melt extending parts to a virtual plane including the boundary face is less than or equal to 0.2 mm.

6. The spark plug according to claim 1, wherein the weld portion is formed by being irradiated with a laser for a plurality of times at a predetermined pitch along an outer circumference end part of the front end member, the plurality of melt extending parts are provided in a part where the laser has been irradiated, and the smaller melt extending part is provided at least in a part where the laser has finally been irradiated.

* * * * *